US012686899B2

(12) United States Patent
Linke et al.

(10) Patent No.: US 12,686,899 B2
(45) Date of Patent: Jul. 21, 2026

(54) PROCESS FOR PRODUCING AN AT LEAST PARTLY QUENCHED AND TEMPERED SHEET STEEL COMPONENT AND AT LEAST PARTLY QUENCHED AND TEMPERED SHEET STEEL COMPONENT

(71) Applicant: ThyssenKrupp Steel Europe AG, Duisburg (DE)

(72) Inventors: Bernd Linke, Duisburg (DE); Janko Banik, Altena (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 622 days.

(21) Appl. No.: 17/763,041

(22) PCT Filed: Sep. 22, 2020

(86) PCT No.: PCT/EP2020/076399
§ 371 (c)(1),
(2) Date: Mar. 23, 2022

(87) PCT Pub. No.: WO2021/063747
PCT Pub. Date: Apr. 8, 2021

(65) Prior Publication Data

US 2023/0002844 A1 Jan. 5, 2023

(30) Foreign Application Priority Data

Sep. 30, 2019 (DE) ..... 102019215053.5

(51) Int. Cl.
*C21D 9/46* (2006.01)
*C21D 1/25* (2006.01)
(Continued)

(52) U.S. Cl.
CPC ..... *C21D 9/46* (2013.01); *C21D 1/25* (2013.01); *C21D 6/004* (2013.01); *C21D 6/005* (2013.01);
(Continued)

(58) Field of Classification Search
CPC . C21D 9/46; C21D 1/25; C21D 6/004; C21D 6/005; C21D 6/008; C21D 8/0205;
(Continued)

(56) References Cited

U.S. PATENT DOCUMENTS 5,830,293 A 11/1998 Meyer et al.
8,518,195 B2 8/2013 Bradley
(Continued)

FOREIGN PATENT DOCUMENTS

CN 101603119 A 12/2009
CN 103732764 A 4/2014
(Continued)

OTHER PUBLICATIONS

Yi Hongliang, et.al. [CN107829037A] (machine translation) (Year: 2017).*
(Continued)

*Primary Examiner* — Sally A Merkling
*Assistant Examiner* — Nazmun Nahar Shams
(74) *Attorney, Agent, or Firm* — RMCK Law Group PLC

(57) ABSTRACT

The invention relates to a process for producing an at least partly quenched and tempered sheet steel component, where the process comprises the following steps: providing a sheet steel, at least partly austenitizing the sheet steel at a temperature of at least Ac, at least partly hardening the at least partly austenitized sheet steel to give an at least partly hardened sheet steel component, where the at least partly austenitized sheet steel is cooled to a temperature below Ms, at least partly annealing the at least partly hardened sheet
(Continued)

Figure 1:
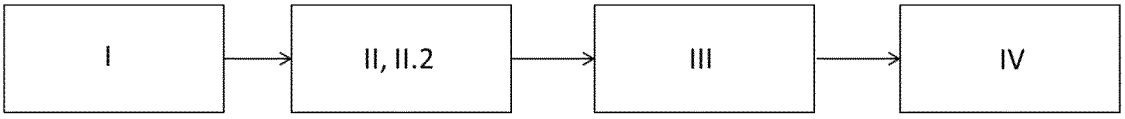

steel component at a temperature of less than Ac1 for producing an at least partly quenched and tempered sheet steel component. A further subject of the invention is an at least partly quenched and tempered sheet steel component.

10 Claims, 3 Drawing Sheets

(51) Int. Cl.

| | |
|---|---|
| ***C21D 6/00*** | (2006.01) |
| ***C21D 8/02*** | (2026.01) |
| ***C21D 8/0247*** | (2026.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.
CPC ..... *C21D 6/008* (2013.01); *C21D 8/02* (2013.01); *C21D 8/0247* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/002* (2013.01); *C21D 2211/008* (2013.01)

(58) Field of Classification Search
CPC ... C21D 8/0247; C22C 38/001; C22C 38/002; C22C 38/02; C22C 38/06; C22C 38/42; C22C 38/44; C22C 38/46; C22C 38/48; C22C 38/50; C22C 38/54; C22C 38/58
See application file for complete search history.

(56) References Cited

U.S. PATENT DOCUMENTS

| | | | | |
|---|---|---|---|---|
| 9,850,553 | B2 * | 12/2017 | Work | C22C 38/28 |
| 11,027,522 | B2 * | 6/2021 | Abukawa | C21D 8/0236 |
| 2008/0196800 | A1 | 8/2008 | Beenken et al. | |
| 2009/0178740 | A1 | 7/2009 | Lenze et al. | |
| 2011/0240179 | A1 | 10/2011 | Lenze et al. | |
| 2012/0090741 | A1 | 4/2012 | Pellmann et al. | |
| 2012/0152410 | A1 | 6/2012 | Sikora et al. | |
| 2014/0065007 | A1 | 3/2014 | Naitou et al. | |
| 2014/0096876 | A1 | 4/2014 | Matsuda et al. | |
| 2014/0299237 | A1 | 10/2014 | Somani et al. | |
| 2014/0367002 | A1 | 12/2014 | Naitou et al. | |
| 2015/0027602 | A1 | 1/2015 | Murakami et al. | |
| 2015/0337406 | A1 | 11/2015 | Muhr et al. | |
| 2016/0024607 | A1 | 1/2016 | Work et al. | |
| 2016/0122889 | A1 | 5/2016 | Muhr et al. | |
| 2016/0145707 | A1 | 5/2016 | Feuser et al. | |
| 2018/0202017 | A1 | 7/2018 | Drillet et al. | |
| 2018/0370578 | A1 * | 12/2018 | Frehn | B62D 25/04 |
| 2019/0126401 | A1 | 5/2019 | Pavlina et al. | |
| 2019/0185958 | A1 * | 6/2019 | Kakiuchi | C22C 38/04 |
| 2021/0115527 | A1 | 4/2021 | Chen et al. | |
| 2022/0316025 | A1 * | 10/2022 | Chen | C21D 8/0278 |

FOREIGN PATENT DOCUMENTS

| | | | |
|---|---|---|---|
| CN | 106011418 | A | 10/2016 |
| CN | 106086364 | A | 11/2016 |
| CN | 106574314 | A | 4/2017 |
| CN | 107523668 | A | 12/2017 |
| CN | 107829037 | A | 3/2018 |
| DE | 102008055514 | A1 | 6/2010 |
| DE | 102010048209 | | 1/2012 |
| DE | 102011101991 | | 8/2012 |
| DE | 102013010025 | A1 | 12/2014 |
| DE | 102013010946 | | 12/2014 |
| DE | 102014210008 | A1 | 11/2015 |
| EP | 2012948 | B1 | 9/2009 |
| EP | 2546375 | B1 | 9/2015 |
| EP | 3320119 | A1 | 5/2018 |
| JP | 2018059156 | A | 4/2018 |
| WO | 2014206514 | A1 | 12/2014 |
| WO | 2016014424 | A2 | 1/2016 |
| WO | 2018099819 | A1 | 6/2018 |

OTHER PUBLICATIONS

[CN106086364B] (Machine translation) (Year: 2017).*
DIN EN 13925-1—Non-destructive testing—X-ray diffraction from polycrystalline and amorphous material, Jul. 2003.
First Chinese Office Action for CN Application No. 202080068223.5 mailed Feb. 14, 2023.
1st German Office Action for DE Application No. 10 2019 215 053.5 mailed Aug. 4, 2020.
International Search Report and Written Opinion for International Application No. PCT/EP2020/076399 mailed Oct. 30, 2020.

* cited by examiner

PROCESS FOR PRODUCING AN AT LEAST PARTLY QUENCHED AND TEMPERED SHEET STEEL COMPONENT AND AT LEAST PARTLY QUENCHED AND TEMPERED SHEET STEEL COMPONENT

CROSS-REFERENCE TO RELATED APPLICATIONS

This application is a 371 U.S. National Stage of International Application No. PCT/EP2020/076399, filed Sep. 22, 2020, which claims the benefit of German Patent Application No. 10 2019 215 053.5 filed Sep. 30, 2019. The disclosures of each of the above applications are incorporated herein by reference in their entirety.

The invention relates to a process for producing an at least partly quenched and tempered sheet steel component, where the process comprises the following steps:

providing a sheet steel, at least partly austenitizing the sheet steel at a temperature of at least Ac1, at least partly hardening the at least partly austenitized sheet steel to give an at least partly hardened sheet steel component, where the at least partly austenitized sheet steel is cooled to a temperature below Ms, at least partly annealing the at least partly hardened sheet steel component at a temperature of less than Ac1 for producing an at least partly quenched and tempered sheet steel component. A further subject of the invention is an at least partly quenched and tempered sheet steel component.

The production of sheet steel components by means of hot-forming is already industrially established, especially for producing vehicle body parts, as for example for producing safety-relevant A pillars, B pillars or both side and crossmembers. These sheet steel components can be produced by either a direct or an indirect hot-forming process. In these processes, flat blanks (directly) or already preformed or near-net-shape (cold-)formed semifinished products/parts (indirectly) comprising a sheet steel, more particularly a hardenable sheet steel, are heated to a temperature at which there is a structural transformation within the sheet steel, dependent on the composition of the sheet steel used. The structural transformation to form austenite begins at a Ac1 and on attainment of Ac3 or above Ac3, the structure present is substantially completely austenitic. The heating above at least Ac1 is also referred to in technical circles as "austenitizing", especially when a complete transformation into austenite is to take place (>=Ac3). After the heating, the hot (austenitized) sheet steel is inserted into a forming tool and hot-formed. Here, in the course of or upon conclusion of the hot-forming, the still-hot sheet steel is cooled, preferably within the forming tool, which is preferably actively cooled, in such a way that the structure is transformed into a hard structure of martensite and/or bainite, preferably substantially of martensite. In technical circles, the cooling or quenching of the sheet steel within the forming tool or by action of a (hardening) tool which has the final contour of the sheet metal component being produced, is also referred to as "press-hardening". Cooling/quenching may alternatively take place outside a forming tool/hardening tool, more particularly in a (cold) medium, in an oil bath for example, and is referred to as "hardening".

Heating and cooling curves for establishing the required structure are dependent on the chemical composition of the hardenable sheet steel used and can be gathered or derived from so-called TTA or TTT diagrams. Hot-forming enables the establishment of a substantially martensitic structure with high strengths. With the conventional hot-forming and/or via the press hardening of steels, especially magnesium-boron steels, for producing structural components in the vehicle sector, a good balance has been found between strength and weight.

A disadvantage of press-hardened structural components, however, is that their elongation behavior is very low, owing to the hard structure established. To improve the elongation at break of a component, it is known practice to subject the hardened components to annealing, which allows the elongation at break behavior to be improved, but also results in a reduction in the strength established by the hardening; see, for example, the applicant's laid-open specification DE 10 2008 055 514 A1.

A targeted strength and elongation at break in components is established using the process known as Q+P (Quenching and Partitioning), in which a sheet steel is austenitized, hot-formed to give a component, and quenched in the process, and subsequently, without the component being cooled to room temperature, is passed to an annealing operation (partitioning) below the structure transformation temperature of Ac1; see, for example, specifications EP 2 546 375 B1, U.S. Pat. No. 8,518,195 B2, DE 10 2013 010 946 B3.

For numerous structural components, for use in a motor vehicle, for example, it is necessary to ensure in a crash scenario that two key functions are fulfilled. Firstly, crash energy should be absorbed by deformation. Secondly the passenger cell must remain protected. One way in which this is achieved is by the local deformation or buckling of certain regions in order to guide the macroscopic deformation. For press-hardened components, the present state of the art achieves this by subjecting individual points to annealing, using lasers, for example, thereby producing in this region a higher local formability and a reduced hardness; see, for example, specification DE 10 2011 101 991 B3. However, this results in a number of critical disadvantages: aftertreatment by means of laser is very costly and also implies a corresponding warpage of components, and so cannot be applied extensively in a way which is economical; for improved local formability it will be necessary to accept a significant loss of strength; the formation of cementite precipitates is stimulated, with the possible consequence of increased sensitivity to cracking, particularly in relation to the reduced strength. Furthermore, the laser is employed on one side, and consequently, in the case of relatively thick components, there may be different states of annealing and hence an uneven distribution of the ductility properties across the thickness.

An object, therefore, is to provide a process which allows an at least partly quenched and tempered sheet steel component to be produced in a manner such that the resulting sheet steel component has a quality which is improved by comparison with the prior art, and can be produced economically.

The object is achieved with a process for producing an at least partly quenched and tempered sheet steel component, having the features of claim 1 .

According to a first teaching of the invention for producing an at least partly quenched and tempered sheet steel component, the process of the invention comprises the following steps: providing a sheet steel; at least partly austenitizing the sheet steel at a temperature of at least Ac1; at least partly hardening the austenitized sheet steel to give an at least partly hardened sheet steel component, where the at least partly austenitized sheet steel is cooled to a temperature below Ms; at least partly annealing the at least partly hardened sheet steel component at a temperature of less than Ac1 for producing an at least partly quenched and tempered sheet steel component, wherein the at least partial annealing for producing the at least partly quenched and tempered sheet steel component is carried out at different temperatures in order to establish regions having different properties on the at least partly quenched and tempered sheet steel component.

The inventors have surprisingly determined that a cost-favorable sheet steel component having goal-directed properties can be produced and that the disadvantages known from the prior art can be compensated in particular through the integration of the Q+P process into the hot-forming and/or hardening operation (quenching) in combination with locally adapted heat treatment parameters during annealing (partitioning). An at least partly quenched and tempered sheet steel component of this kind then has a plurality of regions having different properties, which are established operationally through the at least partial annealing of the sheet steel component at different annealing temperatures (TP1, TP2, TP3, TP4).

In the invention, furthermore, the at least partial annealing, for generating a region having a first property on the at least partly quenched and tempered sheet steel component, is carried out at a first annealing temperature TP1 between 300° C. and 470° C. and, for generating at least one further region having a further property, is carried out at at least one of the following annealing temperatures TP2, TP3, TP4:

- region having a second property: at a second annealing temperature TP2 between 250° C. and 430° C. with TP2<=TP1-10° C.; and/or
- region having a third property: at a third annealing temperature TP3 between 470° C. and less than Ac1; and/or
- region having a fourth property: at a fourth annealing temperature TP4 up to 300° C.

During the at least partial annealing, a (first) region having the first property is established on the at least partly quenched and tempered sheet steel component, with a (first) annealing temperature TP1 between 300° C. and 470° C. being chosen for the purpose of generating the first region. In this temperature range, carbon diffusion within the structure from the martensite into the residual austenite, and also homogenization thereof, can be achieved, preferably in order to ensure a stability criterion (S_RA). Where, additionally, the dissipation of internal stresses is to be promoted, the annealing temperature TP1 is chosen more particularly between 350° C. and 470° C. If the annealing temperature TP1 is chosen preferably between 400° C. and 460° C., the residual austenite can be stabilized particularly easily, preferably within less than 50 s.

During the at least partial annealing, in addition to the first region having the first property, at least one further region having a further property is established on the at least partly quenched and tempered sheet steel component. The first region having the first property is not restricted locally to only one region or only one section on the sheet steel component for at least partial quenching and tempering, but instead may also be present on a plurality of regions or sections of the at least partly quenched and tempered sheet steel component. This may also be the case for the at least one further region having the at least one further property.

The at least one further region may comprise a second region having a second property, where a second annealing temperature TP2 between 250° C. and 430° C. with TP2<=TP1-10° C. is chosen for the purpose of generating the second region. As a result of the second annealing temperature TP2 in the second region, reduced by comparison with the first annealing temperature TP1, it is possible to ensure reduced residue austenite stability by comparison with the first region. For a specifically established hardness, which may be accompanied by a reduction in the elongation at break, the second annealing temperature TP2 is more particularly TP2<=TP1-40° C., preferably TP2<=TP1-80° C.

The at least one further region may comprise a third region having a third property, where a third annealing temperature TP3>470° C. is chosen for the purpose of generating the third region, and so a third region having reduced hardness can be achieved specifically as a result of the high annealing temperature. The third annealing temperature TP3 may be chosen more particularly >500° C., in order, moreover, to accelerate a desired decomposition of carbon-supersaturated residual austenite.

The at least one further region may comprise a fourth region having a fourth property, where a fourth annealing temperature TP4 up to 300° C. is chosen for the purpose of generating the fourth region, with the consequence that, by very low annealing temperatures by comparison with the other annealing temperatures, it is possible to prevent residual austenite stabilization and also softening of the martensite. The fourth annealing temperature TP4 may be chosen in particular <250° C., preferably <200° C., more preferably <100° C., and consequently the fourth annealing temperature TP4 does not necessarily require an increase in temperature after the hardening in the fourth region requiring instead a holding or reduction, according to or dependent on the temperature to which the at least partly hardened sheet steel component has been cooled during the at least partial hardening, so that in the fourth region the austenite has undergone almost complete transformation into martensite prior to exposure to the fourth annealing temperature TP4, more particularly holding temperature, and this may lead to a particularly uniform distribution of hardness in the fourth region. The fourth annealing temperature TP4 may be at least 0° C., more particularly at least 20° C., preferably at least 25° C., more preferably at least 30° C., with further preference at least 40° C., very preferably at least 50° C., in order, for example, to obtain a higher yield point than comparatively at temperatures below 0° C.

The sheet steel may be a substantially flat sheet steel or a preformed sheet steel having a constant thickness of up to 10.0 mm, more particularly up to 6.0 mm, preferably up to 3.5 mm, more preferably up to 2.0 mm. The sheet steel has a thickness of at least 0.5 mm, more particularly of at least 0.8 mm, preferably of at least 1.0 mm. The sheet steel may both be hot-rolled and cold-rolled. Alternatively a flat sheet steel or a preformed sheet steel with varying thickness (tailored rolled blank) may also be provided. Furthermore, sheet steel may also refer to a tailored product which consists of at least two steel sheets varying in thickness and/or grade and bonded to one another, more particularly by substance-to-substance bonding, in the form of flat semi-finished product (sheet steel) or of a preformed part (sheet steel), patchwork blank or tailored welded blank. Furthermore, the sheet steel may also have been provided with a coating, in which case preferably a metallic coating based on aluminum or zinc is employed. This coating may be applied via a hot dip, electrolytic or coil coating operation to the coiled or ready-precut sheet steel.

The sheet steel is heated to form austenite, or austenitized, at least partly to a temperature of at least Ac1 or above, more particularly to at least Ac3 or above, preferably in a period which is sufficient in order, depending in particular on the thickness of the sheet steel used, to produce full heating right through the thickness of the sheet steel and/or to substantially homogenize the carbon in the austenite present in the sheet steel, and/or, if the sheet steel has a metallic coating, to ensure substantially an alloying of the coating which enables, in particular, more rapid processability in the forming operation. In the case of austenitization between Ac1 and Ac3, the austenite content and the carbon content in the austenite are dependent on the austenitization time, and so complete austenitization >Ac3 is preferred.

"Hardening" means that, the sheet steel, as a result of the targeted austenitization, as is carried out in the case of direct and indirect hot-forming for producing a sheet steel component, the sheet steel component at least in part (partially/locally) has a higher hardness or strength by comparison with the sheet steel provided. The at least partial hardening may take place in a tool (press hardening) or in a medium (hardening). Where the at least partly austenitized sheet steel is cooled to a temperature below Ms, it is possible to ensure that the development of a hard structure of austenite at least partially into martensite is forcibly brought about, in particular through suitable cooling rates. The average cooling rate is in particular at least 10 K/s, preferably at least 15 K/s, more preferably at least 20 K/s, and cooling rates 50 K/s up to 300 K/s are also possible. The transformation fully into martensite should be concluded when the temperature reaches or falls below the Mf temperature. This is undesirable in the invention, and so in particular a temperature between Ms and Mf is chosen, this temperature lying preferably below the temperature at which preferably at least 50% of the austenite can transform into martensite.

Parameters such as Ac1, Ac3, Ms, Mf, (critical) cooling rates, etc., are dependent on the steel composition used and may be derived from so-called TTT or TTA diagrams.

Further advantageous embodiments and developments are apparent from the following description. One or more features from the claims, the description or else the drawing may be linked with one or more other features therefrom to form further embodiments of the invention. It is also possible for one or more features from the independent claims to be linked by one or more other features.

According to one embodiment of the process of the invention, the at least partial annealing is carried out temporally immediately after the hardening, and so the heat still present in the at least partly hardened sheet steel component can be utilized in order to allow the sheet steel component to be heated more rapidly to the target temperatures during the at least partial annealing, thereby allowing the process to be operated more quickly and therefore more economically. The direct annealing also enables part of the austenite to be stabilized to an extent such that in the further course of the operation it is no longer transformed into martensite and is present as residual austenite in the eventual component.

According to one embodiment of the process of the invention, between the regions having different properties on the at least partly quenched and tempered sheet steel component, one or more transition regions are established which have a harmonic transition of the property profile between the regions having different properties. In this way it is possible to prevent a sudden or abrupt and hence destruction-prone transition (metallurgical notch).

According to one embodiment of the process of the invention, a sheet steel having the following chemical composition in wt % is provided:

C=0.08 to 0.5,
Si+Al>=0.5, with Si+2*Al<5,
Mn=0.5 to 4,
and optionally one or more of the following elements:
P up to 0.1,
S up to 0.1,
N up to 0.1,
Cr up to 1.5,
Mo up to 1,
Ti up to 0.2,
B up to 0.01,
Nb up to 0.2,
V up to 0.5,
Ni up to 2,
Cu up to 2,
Sn up to 0.5,
Ca up to 0.1,
Mg up to 0.1,
REM up to 0.1,
balance Fe and unavoidable impurities.

Carbon (C) takes on a number of important functions. Primarily C is a martensite former and hence essential to the establishment of a desired hardness in the at least partly hardened or at least partly quenched and tempered sheet steel component, and accordingly at least an amount of 0.08 wt %, more particularly at least an amount of 0.1 wt %, preferably at least an amount of 0.15 wt % is present in order to allow the residual austenite as well to be stabilized with carbon. Furthermore, C makes a large contribution to a higher CEV (CEV=carbon equivalent), thereby negatively influencing the welding propensity, and accordingly an amount up to a maximum of 0.5 wt %, more particularly up to a maximum of 0.44 wt % for the purpose of producing the propensity toward inward cracks, preferably up to a maximum of 0.38 wt %, more preferably up to a maximum of 0.35 wt %, is established. It is also possible by means of the specified upper limit to prevent negative influences in terms of the toughness properties, the forming properties and the welding propensity. Depending on required formability and toughness, the C content may be established individually within the specified ranges.

Silicon (Si) as an alloy element may act as a deoxidation element, alternatively or additionally to aluminum, and can therefore be alloyed in with an amount of not more than 3 wt %. In order to ensure efficacy, an amount of at least 0.01 wt % is used more particularly. However, Si may also contribute to boosting strength, and so preferably an amount of at least 0.1 wt %, more preferably of at least 0.15 wt %, is alloyed in. If too much Si is alloyed into the steel, this may have a negative influence on the toughness properties, the formability and the welding propensity. The amount is therefore limited in particular to not more than 3 wt %, preferably to not more than 1.6 wt % for the purpose of improving the surface quality, more preferably to not more than 1.4 wt %, in order to improve wetting in the case of hot dip finishing.

Aluminum (Al) may be alloyed in alternatively or additionally to the silicon as an alloy element for deoxidation, in amounts of at least 0.01 wt %. More particularly Al can be used for the binding of any nitrogen present, allowing optionally alloyed-in boron to develop its strength-boosting effect. The amount alloyed in is therefore more particularly at least 0.02 wt %, preferably at least 0.1 wt %. Al may also be used for reducing density. In order to avoid casting problems, the amount is limited to not more than 1 wt %, more particularly to not more than 0.8 wt %.

In order to suppress the formation of cementite from the carbon-supersaturated martensite, a certain alloying-in of Si and/or Al is required, and so Si+Al>0.5 wt % is alloyed in. For this to be ensured in a broad operational window as well, more particularly Si+Al>0.75 wt % is alloyed in. If preferably Si+Al>1.3 wt % is alloyed in, the major part of the carbon is able to partition into the carbon-supersaturated austenite, and cementite precipitates can be substantially prevented. In order to allow austenite to be formed in the austenitizing, the amount of ferrite formers such as Si and Al that are readily soluble in the iron lattice must be limited to Si+2*Al<5 wt %. In order to allow a reduced austenitization temperature, more particularly in order to lower Ac3, the alloying is limited more particularly to Si+2*Al<3 wt %.

Manganese (Mn) is an alloy element which contributes to the hardenability. At the same time Mn reduces the propensity to unwanted formation of pearlite during cooling and lowers the critical cooling rate, thereby increasing the hardenability. Moreover, Mn may be used for the binding of S, to prevent the capacity for hot-rolling being excessively impacted by an FeS eutectic, and/or for reduction in the pearlite fraction, and so more particularly an amount of at least 0.5 wt % is present. Too high a concentration of Mn, conversely, is adverse for the welding propensity, and so Mn is limited to not more than 4 wt %. In order to ensure the desired formability, the amount is limited in particular to not more than 3 wt %, and preferably to not more than 2.5 wt % in order to improve the toughness properties. For the purpose of establishing the desired strength properties, an amount in particular of at least 0.8 wt % is alloyed in, preferably at least 1.0 wt %. If the aim is to stabilize carbon-supersaturated residual austenite for particularly long annealing times, Mn is alloyed in preferably with at least 1.7 wt %.

The sheet steel may optionally comprise one or more alloy elements from the group of (P, S, N, Cr, Mo, Ti, B, Nb, V, Ni, Cu, Sn, Ca, Mg, REM).

Phosphorus (P) is an optional alloy element, which can be established in order to retard the formation of cementite and so to stabilize the residual austenite, in amounts up to 0.1 wt %. In order to ensure the desired retardation and stabilization, amounts established are in particular at least 0.004 wt %, preferably at least 0.007 wt %. However, P has a strongly toughness-lowering effect and is therefore adverse to the formability. Because of its very different activity in the melt and in the solidified steel, moreover, P may lead to instances of severe segregation during solidification of the melt. Negative influences on the formability and/or weldability can be reliably ruled out if the amount is limited in particular to not more than 0.05 wt %, preferably to not more than 0.03 wt % for additionally reducing the segregation effects.

Sulfur (S) may be established as an optional alloy element in amounts of up to 0.1 wt %, in order to contribute to the ductility in the case, for example, of any possible welding performed on the sheet steel component, by virtue of the sulfur, precipitated as sulfide with Mn and/or Fe, reducing grain coarsening in the austenite after solidification. In order to achieve the desired effect, the amount established is more particularly at least 0.0002 wt %, more particularly at least 0.0005 wt %. In the steel, however, S exhibits a strong propensity to segregation and may negatively impact the formability or toughness as a result of excessive formation of Fes, MnS and/or (Mn, Fe)S. The amount is therefore limited in particular to not more than 0.05 wt %, preferably to not more than 0.03 wt %, more preferably to not more than 0.01 wt %.

Nitrogen (N) may be established an optional alloy element in amounts up to 0.1 wt % for forming nitride and/or improving the hardenability. In steel making, N cannot be fully avoided in principle, owing to the N-containing atmosphere of the earth, but depending on other alloy elements, N may be very advantageous. Just like C, N can be used to boost the martensite hardness, but weakens the grain boundaries to less of an extent than C. In order to obtain this effect, the amounts established are in particular at least 0.0005 wt %, preferably at least 0.001 wt %, more preferably at least 0.002 wt %. In particular in conjunction with Al and/or Ti, however, N leads to the formation of coarse nitrides, which may have adverse consequences for the formability. The amount is therefore limited in particular to not more than 0.015 wt %, preferably to not more than 0.01 wt %, more preferably to not more than 0.007 wt %. If Ti is present, in the case of Ti amounts>0.01 wt %, the amount of N ought with particular preference to be established between 0.001%<N<0.004%.

Chromium (Cr) can be alloyed in as an optional alloy element for establishing the hardness and strength, in particular with an amount of at least 0.01 wt %, since like C it is able to support the transformation into austenite and also to retard the formation of ferrite and pearlite on quenching. For reasons of cost, the upper limit is defined at 1.5 wt %. If the amount is too high, the welding propensity and/or the toughness may be negatively influenced, and hence the amount is limited in particular to not more than 0.75 wt %, preferably to not more than 0.45 wt %. In order to lower the carbon diffusion and so to promote transformation remote from equilibrium, amounts alloyed in are, in particular, at least 0.01 wt %, preferably at least 0.1 wt %, more preferably at least 0.15 wt %.

Molybdenum (Mo) as an optional alloy element may increase the strength and the hardness. Because it is able to contribute to boosting the activity of Cr and/or may replace the use of that alloying element, it may be alloyed in optionally with an amount of up to 1 wt %, more particularly between 0.01 and 0.8 wt %, preferably between 0.1 and 0.5 wt % for the purpose of maximizing hardness and reducing the carbon diffusion.

In order to prevent the formation of ferrite during cooling, both Cr and/or Mo may be alloyed in as well as Mn. In order to form a sufficient amount of martensite, the following condition ought to be fulfilled: Mn+Cr+2*Mo>=1 wt %. In order to prevent premature structure transformation, in the case of transfer between the austenitizing and the hardening, for example, the following condition in particular ought to be fulfilled: Mn+Cr+2*Mo>=1.8 wt %. In order to stabilize the process for producing a quenched and tempered sheet steel component and/or to suppress formation of bainite substantially during the annealing, the following condition ought preferably to be fulfilled: Mn+Cr+2*Mo>=2.4 wt %.

Titanium (Ti) as an optional alloy element may boost the strength by forming carbides, nitrides and/or carbonitrides, and may act as a microalloy element. It is also possible to suppress the formation of coarse austenite structure, more particular to stabilize the residual austenite in dissolved form. Ti may also contribute to grain refinement and/or nitrogen binding and, if boron is present, may increase the activity of boron. Since, moreover, it can contribute to boosting the activity of Ci, it may be alloyed in optionally with an amount of up to 0.2 wt %. For reasons of cost, the amount is limited in particular to not more than 0.15 wt %, preferably to not more than 0.1 wt % for reliably preventing the formation of excessively large titanium nitrides, and more preferably to not more than 0.05 wt %. In order to ensure the activity, an amount in particular of at least 0.005 wt % can be alloyed in. For the purpose of exploiting the strength-boosting effect, it is possible with preference to use amounts of at least 0.01 wt %, more preferably at least 0.015 wt %.

Boron (B) as an optional alloy element is able to segregate at the phase boundaries and prevent their movement. This may lead to a fine-grain structure, which may be beneficial to the mechanical properties. More particularly, B may lower the energy of austenite/austenite grain boundaries, thereby allowing the nucleation of ferrite during cooling to be suppressed. In order to ensure the activity of these effects and to increase the hardenability, an amount of up to 0.01 wt %, more particularly up to not more than 0.005 wt %, may be alloyed in, and preferably up to not more than 0.004 wt % for reliably preventing embrittlement at grain boundaries, and more particularly at least 0.0005 wt % for the purpose of ensuring the reliable activity even in the presence of N, in the form of technically unavoidable N impurities in the steel melt, for example, and preferably of at least 0.0010 wt %, more preferably at least 0.0015 wt %, to increase the fine-grain quality. In the case of the optional alloying-in of B, moreover, sufficient Ti and/or Al for the binding of N should be alloyed in.

Vanadium (V) and/or niobium (Nb) may be alloyed in as optional alloy elements individually or in combination for grain refinement, for stabilization of residual austenite and/or for retarding the hydrogen-induced cracking. Like Ti, these optional alloy elements may be used as microalloy elements in order to form strength-boosting carbides, nitrides and/or carbonitrides. In order to ensure their activity, V and/or Nb may be used in particular with amounts of (in each case) at least 0.005 wt %, preferably of at least 0.01 wt %, more preferably of at least 0.015 wt %. For Nb and V, the minimum amount, individually or in total, is more preferably at least 0.02 wt %. V is limited to not more than 0.5 wt %, more particularly to not more than 0.2 wt %, preferably to not more than 0.1 wt %, since higher amounts may have deleterious consequences for the materials properties, and more particularly may adversely affect the toughness properties of the steel. Because of its relatively low solubility product of C, Nb is limited to not more than 0.2 wt %, more particularly to not more than 0.1 wt %, preferably to not more than 0.06 wt %, in order to allow the formation of extremely fine and finely divided niobium carbides and niobium carbonitrides.

Nickel (Ni) as an optional alloy element may stabilize the austenite and improve the hardenability, and so optionally an amount of up to 2 wt % can be alloyed in. In order to ensure the activity, an amount more particularly of at least 0.02 wt % can be alloyed in. To promote the desired phase transformation, amounts preferably of at least 0.05 wt % may be alloyed in, and preferably at least 0.1 wt % in order to increase the toughness. To improve the weldability, the amount is limited preferably to not more than 2 wt %, and for reasons of cost preferably to not more than 1.5 wt %, more preferably not more than 0.8 wt %.

Copper (Cu) as an optional alloy element can be alloyed in with an amount of up to 2 wt % for the purpose of improving the hardenability and the precipitation hardening during the annealing. In order to ensure this effect, amounts more particularly of at least 0.01 wt %, preferably of at least 0.05 wt %, may be alloyed in. The amount is limited in particular to not more than 1 wt %, preferably to not more than 0.5 wt %, in order to prevent negative influences on the welding propensity and the toughness properties in the heat-effective zone of any possible welding performed on the sheet steel component.

Tin (Sn) may be alloyed in as an optional alloy element with an amount of up to 0.5 wt % in order to be able to increase the toughness and to suppress the precipitation of cementite at the grain boundaries. In order to ensure at least a minor activity, an amount in particular of at least 0.001 wt % is alloyed in. In order to ensure this effect to an increased extent, the amount alloyed in is preferably at least 0.002 wt %. To prevent deterioration in the toughness of the steel, the upper limit is restricted in particular to not more than 0.4 wt %, preferably to not more than 0.25 wt %, more preferably to not more than 0.1 wt %.

Calcium (Ca) as an optional alloy element may be added as an alloy to the melt, as a desulfurizing agent and for the targeted influence in the sulfide, in amounts up to 0.1 wt %, more particularly up to a maximum of 0.05 wt %, preferably up to a maximum of 0.01 wt %, more preferably to a maximum of 0.005 wt %, and this may alter the plasticity of the sulfides during hot-rolling. The effects described may be active starting from an amount in particular of at least 0.0005 wt %, preferably of at least 0.001 wt %.

Magnesium (Mg) may be alloyed in as an optional alloy element, alternatively or additionally to Ca, to the melt for the targeted influencing of sulfide, in amounts up to 0.1 wt %, more particularly up to a maximum of 0.05 wt %, preferably up to a maximum of 0.01 wt %, more preferably up to a maximum of 0.005 wt %, and this may alter the plasticity of the sulfides during hot-rolling. The effects described may be active starting from an amount in particular of at least 0.0005 wt %, preferably of at least 0.001 wt %.

Rare earth metals such as cerium, lanthanum, neodymium, praseodymium, yttrium and others, which are abbreviated individually or collectively to REM, may be added as optional alloy elements in order to bind S, P and/or O and to reduce or entirely prevent the formation of oxides and/or sulfides and also of phosphorus segregations of grain boundaries and so to increase the toughness. Furthermore, REM may contribute to the refinement of precipitates and/or inclusions. In order to achieve a perceptible effect, the amount alloyed in when using REM is more particularly at least 0.0005 wt %, preferably at least 0.001 wt %. The REM content is limited to not more than 0.1 wt %, more particularly to not more than 0.05 wt %, preferably to not more than 0.01 wt %, in order not to form too many additional precipitates which may negatively influence the toughness. For reasons of cost, REM is alloyed in preferably at up to a maximum of 0.005 wt %.

The alloy elements indicated as being optional may alternatively also be tolerated as impurities in amounts below the specified minimum limits, without influencing, and preferably not detracting from, the properties of the steel.

All figures for amounts of the alloy elements indicated in the present specification are based on the weight, in wt %.

According to one embodiment of the process of the invention, the sheet steel is hot-rolled and preferably cold-rolled, where the sheet steel, in particular in addition to the chemical composition stated above, contains preferably less than 10% of ferrite grains having an equivalent diameter >50 μm, in order to ensure a uniform distribution of carbon after the at least partial austenitization. This is an advantage in particular in order to be able to achieve a precise amount of martensite on quenching between Ms and, for example, 50° C. When there is a locally increased carbon content in the austenite, the martensite formation shifts to lower temperatures, and so less martensite may be formed at this point for a quenching temperature previously defined. Correspondingly, at points or in regions with a lower carbon content, more martensite may be formed. Such local, uncontrollable inhomogeneities in the amount of martensite formed are not desirable, for example, but can be reduced or even avoided by means of fine distribution of carbon prior to the austenitization, described by less than 10% of ferrite grains having an equivalent diameter>50 μm, preferably >30 μm.

The equivalent diameter of a ferrite grain corresponds to the diameter of a circle having the same area as the ferrite grain (in polished section).

According to one embodiment of the process of the invention the at least partial hardening is carried out in a press-hardening tool. The use of a press-hardening tool enables the production of a sheet steel component with particular dimension integrity, since the at least partly austenitized sheet steel makes contact with a shaping contour of the press-hardening tool. In order to achieve at least partial hardening, the press-hardening tool is actively cooled and provides corresponding cooling rates in order to allow the establishment of a hard structure in the at least partly hardened sheet steel component (quenching). The press-hardening tool produces only minimal shaping as part of a calibration and/or correction to target dimensions or to ultimate geometry of the sheet steel component being produced. This embodiment preferably takes account of the indirect heat forming, where a sheet steel which has already been preformed or formed to near-net shape after the austenitizing is hardened or press-hardened in the press-hardening tool.

Alternatively the at least partial hardening in the case of indirect hot-shaping may also comprise hardening in a medium, in air or in a liquid medium, more particularly with or without securement of the sheet steel component to be hardened.

According to one embodiment of the process of the invention, before the at least partial hardening, the at least partly austenitized sheet steel is hot-formed in at least one hot-forming tool. The direct hot-forming preferably takes account of the provision of a substantially flat sheet steel, which after the austenitizing is hot-shaped in at least one hot-shaping tool. The hot-shaping may also take place in two or more hot-shaping tools, depending on the complexity of the sheet steel component being produced and/or depending on the cycle time. The subsequent at least partial hardening may take place either additionally in the at least one hot-forming tool, by means of hot-forming and press hardening, or in at least one hot-forming tool by means of hot-forming and subsequently in at least one press-hardening tool.

As an alternative it is also possible to conceive of the hot-forming of the at least partly austenitized sheet steel in at least one hot-forming tool, by means of hot-forming, and subsequently of hardening in a medium, in air or in a liquid medium, to give an at least partly hardened sheet steel component, more particularly with or without securement of the sheet steel component to be hardened.

According to one embodiment of the process of the invention the at least partial annealing is carried out in at least one annealing tool which has at least two differently temperature-conditioned regions/zones. At its most simple, the at least one annealing tool is preferably constructed similarly to the hot-forming tool and/or press-hardening tool, with contours which come into contact with the at least partly cured sheet steel component and corresponds to the ultimate geometry of the sheet steel component for at least partial quenching and tempering.

The annealing tool has at least one region (first zone) for establishing the first region having the first property, which is operated with an annealing temperature TP1, and at least one further region (at least one further zone) for establishing at least one of the second, third and/or fourth regions having at least the second, third and/or fourth property, where this at least one further region (at least one further zone) in the annealing tool is operated with at least one of the second, third and/or fourth annealing temperatures (TP2, TP3 and/or TP4). The annealing tool is therefore differently temperature-conditionable, more particularly actively differently temperature-conditionable. The different annealing temperatures may also be established by locally different heat transitions and/or heat conductivities in the annealing tool.

Alternatively it is also possible to conceive of the annealing of the at least partly hardened sheet steel component in at least one temperature-conditioning unit which has at least two different temperature-conditioning zones for establishing the different properties on the sheet steel component for at least partial quenching and tempering. The temperature-conditioning unit may be, for example, a furnace having different temperature-conditioning zones, more particularly with heat sources which can be triggered differentially. In at least one of the temperature-conditioning zones, for example, the prevailing temperature may be at least 0° C., more particularly at least 20° C., preferably at least 25° C., more preferably at least 30° C., more preferably still at least 40° C., very preferably at least 50° C. This temperature zone or zones may for example not be actively conditioned.

The annealing time is dependent on the annealing temperature or temperatures (TP1) and (TP2, TP3 and/or TP4), and so highly variable values are possible, from 1 s to 3600 s. For operational reasons, the at least partial annealing is carried out more particularly in an annealing time between 5 s and 100 s, with preferably a maximum annealing time of 70 s, more preferably a maximum annealing time of 50 s, for particularly time-efficient throughput.

The second teaching of the invention relates to an at least partly quenched and tempered sheet steel component which has regions having different properties: a first region having a first property, comprising a microstructure with residual austenite between 3% and <35%, 35% to 97% martensite, up to 30% bainite and unavoidable structure constituents, and at least one further region having a further property, comprising at least one of the following properties:

- a second region having a second property, comprising a structure having a residual austenite fraction which is lower by comparison with the first region, balance martensite and optionally bainite and unavoidable structure constituents, and/or
- a third region having a third property, comprising a structure having a residual austenite fraction which is lower by comparison with the first region and, if present, by comparison with the second region, balance martensite and optionally bainite and unavoidable structure constituents, and/or
- a fourth region having a fourth property, comprising a structure having <3% residual austenite, balance martensite and optionally bainite and unavoidable structure constituents.

Martensite here may comprise unannealed, annealed and decarburized martensite. Bainite, if present, may comprise lower, upper, globular and acicular bainite.

The at least partly quenched and tempered sheet steel component of the invention fundamentally always has a first region having a first property, which ensures particularly good local formability in conjunction with high strength. In addition the at least partly quenched and tempered sheet steel component has at least one further region having at least one further property, which can be established depending on the required properties. The at least one further region may comprise a second region, a third region and/or a fourth region. Not only the first region but also the at least one further region may be present in one section or in two or more sections locally on the quenched and tempered sheet steel component. According to configuration, the at least partly quenched and tempered sheet steel component may more particularly have up to four different properties.

Remaining structure constituents may be present in the form of ferrite, pearlite and/or cementite. The remaining structure constituents are in particular <5%, preferably <2%, more preferably <1%. The structure constituents stated are determined by evaluation of investigations by light microscopy or electron microscopy and are therefore to be understood as area proportions in area %. An exception to this is the austenite or residual austenite structure constituent, which is specified as a volume fraction in vol %.

The first region having the first property, which is present locally in one or more regions or sections of the at least partly quenched and tempered sheet steel component, exhibits particularly good local formability. The first region having the first property comprises a structure with residual austenite (A_RA) between 3% and <35%, 35% to 97% martensite, up to 30% bainite and unavoidable structure constituents. The fraction of residual austenite A_RA may contribute to the local formability, in particular with compliance with a residual austenite stability value (S_RA), in that a low solidification exponent is achieved, owing to the very minimal solidification with increasing forming/dislocation density; as a result, a local forming may proceed with a small increase in tension, thereby enabling cracking by attainment of a critical cracking tension to be retarded. Alternatively or additionally, the residual austenite may be situated in lamellar form between martensite laths, allowing crack propagation to be inhibited. Alternatively or additionally, an increase in dislocations in the surrounding martensite during deformation may be reduced by the presence of residual austenite, thereby limiting not only the deformation solidification but also the difference in hardness relative to the residual austenite. In this way it is possible for example to retard crack initiation. The fraction of residual austenite ought more particularly to be limited to <30%, preferably to <25%, more preferably to <20%, so that the yield point in the at least partly quenched and tempered sheet steel component remains sufficiently high.

The optionally present second region having the second property features a greater resistance to deforming or buckling than the first region having the first property. This may be provided by a higher hardness and greater solidification by comparison with the first region. As a result of the comparatively greater solidification, the forming is shifted into less strengthening regions, as into the first region, for example. As a result in particular of a reduced stability (S_RA) by comparison with the first region, the residual austenite in the second region undergoes earlier stress-induced and/or deformation-induced transformation to martensite, resulting in a boost to strength in the second region. As a result of this, the forming shifts into the less solidified region, more particularly into the first region. The somewhat less stable residual austenite in the second region therefore contributes to a concentration of deformation in the first region.

The optionally present third region having the third property features a particularly low hardness and also solidification. This allows a variety of functions to be pictured, more particularly operations which follow the hardening, such as, for example, the hole widening, can be improved; the trimming can be made much easier and the cutting quality improved; welding can be facilitated and the extent of the drop in hardness between base material and heat-effected zone of the weld can be significantly reduced; the provision of predetermined deformation sites, which in the event of a low-speed crash are able to absorb energy without plastic deformation of further components, more particularly the rest of the vehicle body, thereby enabling a significant reduction in the cost and complexity of repairs. The third region contains a structure having a residual austenite fraction A_RA which is lower than that of the first region and, if present, lower than that of the second region. In particular the A_RA of the third region is lower by at least 3% than the A_RA of the first region, preferably lower than 3% based on the A_RA of the third region (including 0). Because of the reduced residual austenite fraction, the amount of stress-induced and/or deformation-induced martensite potentially formed can also be reduced, and this allows not only the cutting operation but also local deformation operations, hole widening for example, to be improved, meaning that the associated solidification can also be reduced.

The optionally present fourth region and the fourth property features particularly high hardness and is accordingly designed particularly for one or more regions or sections on an at least partly quenched and tempered sheet steel component, in order for the shape to be retained as faithfully as possible in a crash scenario, with little elongation. Because the lower strength of the residual austenite fraction means that it does not exert any direct supporting effect in the structure, an amount <3% (including 0) should be established for a maximum deformation resistance.

In order to avoid repetition, reference is made to the observations concerning the process of the invention.

The first region having the first property on the sheet steel component of the invention is designed to absorb crash energy in the event of a crash and to dissipate it by deformation. According to one embodiment of the sheet steel component of the invention, the first region having the first property and the at least one further region having the at least one further property may be characterized further by variables such as the residual austenite stability value, conveyed by an Si- and/or Al-corrected lattice parameter (S_RA), and/or a structure hardness value Hv_rC. The first region has a value S_RA>0.3590 nm, preferably >0.3598 nm, more preferably >0.3606 nm. The residual austenite stability is conveyed by the Si- and/or Al-corrected lattice parameter. This stability ought to be particularly high, in order to minimize the solidification due to stress-induced and/or deformation-induced formation of martensite. The greater the lattice parameter, the higher the fraction of alloy elements dissolved in the residual austenite lattice—in particular, C, Mn and optionally Cr can increase the residual austenite stability. Si and Al, conversely, are particularly effective ferrite formers, which also influence the lattice parameter. The residual austenite lattice parameter should therefore be corrected for Si and Al, according to the following formula:

$$S_RA = G_RA - 0.0002\ \text{nm}*\%\ Si - 0.0006\ \text{nm}*\%\ Al + 0.0004\ \text{nm}*\%\ Mn.$$

If the S_RA>0.3598 nm is exceeded, the residual austenite stability is increased to an extent such that stress-induced formation of martensite can barely still take place. If the S_RA>0.3606 nm is exceeded, the deformation-induced formation of martensite as well is limited to an extent such that even relatively large austenite regions remain stable. In the event of failure to comply with S_RA>0.3598 nm, the residual austenite is transformed into martensite even with very low stresses. As a result there is a large difference in hardness in the structure, which goes directly against the objective of a high local formability. Furthermore, as a result of local forming which accompanies the formation of martensite, and which is known as "Bain strain", there may be warpage of components even in the face of very low, global stresses.

S_RA is calculated in such a way as to compensate for the influence of alloying elements both on the lattice constant and on the residual austenite stability. The residual austenite lattice parameter (G_RA) is determined from the x-ray diffractogram, in accordance with DIN 13925 "X-ray diffractometry of polycrystalline and amorphous materials" using the Rietveld method.

The first region additionally or alternatively has a structure hardness value Hv_rC<320+800*(% C+% N)+75*(% Nb)^0.5. Various alloy elements add up to the hardness of the structure. Whereas boosting strengths through the carbon or precipitates have 25 virtually no influence on the solidification during deformation, structural stresses lead to an unwanted solidification during deformation. If the inequation above is met, the coarsest tensions in the structure are dissipated. If, in particular, Hv_rC<290+750*(% C+% N)+50*(% Nb)^0.5, internal tensions are significantly reduced, and almost completely dissipated if preferably Hv_rC<270+700*(% C+% N)+30*(% Nb)^0.5.

Hv_rC is a measured Vickers hardness (Hv1). The inequation takes account of the annealing effect (lower hardness than hardened right through (martensite as a function of C and N) and fully hardened/grain-refined (precipitates as a function of Nb)). The condition requires a hardness which is lower than the maximum hardness achievable in light of the chemical composition.

The optional second region having the second property has a value S_RA which is lower than the S_RA of the first region. In order to enable considerable stress-induced and/or deformation-induced formation of martensite in the second region, and to establish a certain distance relative to the first region, and before this begins in the first region, the S_RA is lower by at least 0.0004 nm than the S_RA of the first region. If the S_RA is lower, preferably, by at least 0.0010 nm than the S_RA of the first region, it is possible to achieve a very extensive transformation of residual austenite in the second region in conjunction with a minimal transformation of residual austenite in the first region.

The optional second region having the second property alternatively or additionally has a value Hv_rC which is greater than the Hv_rC in the first region, and consequently the deformation takes place primarily in regions of relatively low hardness, if only a first region and no third region is present, in other words takes place more in the first region. More particularly the Hv_rC is greater by at least 10 Hv than the Hv_rC in the first region. In particular the Hv_rC of the second region is greater by up to a maximum of 120 Hv, more preferably up to a maximum of 100 HV, than the Hv_rC in the first region, preferably greater by up to a maximum of 40 Hv than in the first region. In this way it can be ensured that the deformation of the component in a crash scenario also extends to the second region before the first region suffers critical failure.

The optional third region having the third property has a residual austenite fraction which is kept small, so that it is not automatically necessary to establish a particular residual austenite stability. If the residual austenite fraction in the third region is A_RA>0, then the value S_RA>0.3595 nm, more particularly S_RA>0.3600 nm, is established in order to be able substantially to suppress the stress-induced and/or deformation-induced formation of martensite.

The optional third region having the third property alternatively or additionally has a value Hv_rC which is lower by at least 10 HV than the Hv_rC in the first region, preferably lower by at least 25 HV than the Hv_rC in the first region, for improved hole widening, more preferably lower by at least 50 Hv than the Hv_rC in the first region, in order to enable cut edges of extremely high quality and to enable low cutting forces.

In the presence of a residual austenite content A_RA between >0% and <3%, the optional fourth region having the fourth property has a value S_RA<0.3595 nm, more particularly S_RA<0.3590 nm, in order for the residual austenite to be transformed as rapidly as possible into martensite and hence to contribute to the deformation resistance.

The optional fourth region having the fourth property additionally or alternatively has a value Hv_rC which is greater by at least 40 Hv than the Hv_rC of the first region, in order to guide the deformation into other regions when the component is loaded. More particularly the Hv_rC is greater by at least 60 Hv, preferably by at least 80 Hv, than the Hv_rC in the first region, in order for the quenched and tempered sheet steel component to retain its original shape as closely as possible in a crash scenario. If the optional second region is present, the Hv_rC of the fourth region is greater by at least 10 Hv than the Hv_rC of the second region.

According to one embodiment of the sheet steel component of the invention the at least partly quenched and tempered sheet steel component, between the regions having different properties, has one or more transition regions, where the transition region or regions space the various regions from one another with a transverse extent of at least 5 mm, in order to provide a harmonic and non-sudden transition of the profile of properties between the individual regions having different properties. The transverse extent is more particularly at least 20 mm, preferably at least 50 mm. The transverse extent of the transition region between the individual regions is, for example, not more than 400 mm, more particularly not more than 250 mm, preferably not more than 150 mm, more preferably not more than 100 mm. In a manner particularly advantageous for component design and quality of forecasting of the service properties, the transverse extent of the transition region between the regions with different properties is very preferably between 10 mm and 50 mm.

Specific embodiments of the invention are elucidated in more detail below with reference to the drawing. The drawing and accompanying description of the resultant features should not be read as limiting on the respective embodiments, instead serving to illustrate the exemplary embodiment. Furthermore, the respective features can be utilized with one another and also with features of the above description for possible further developments and improvements of the invention, specifically in the context of additional embodiments which are not illustrated.

IN THE DRAWING

Figure 2:
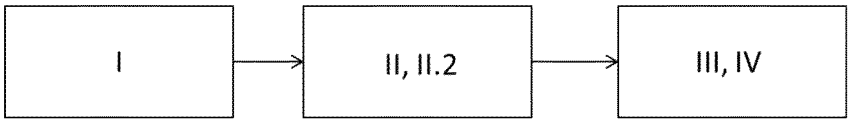
Figure 3:
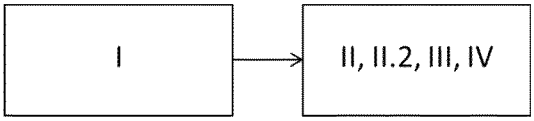
Figure 4:
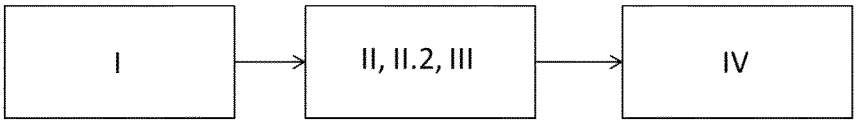
Figure 5:
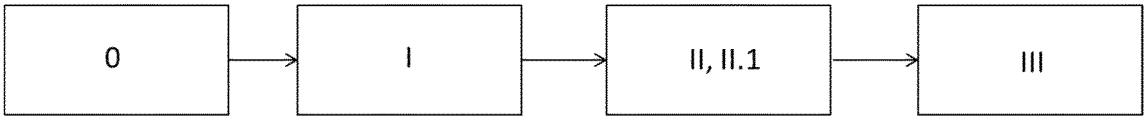
Figure 6:
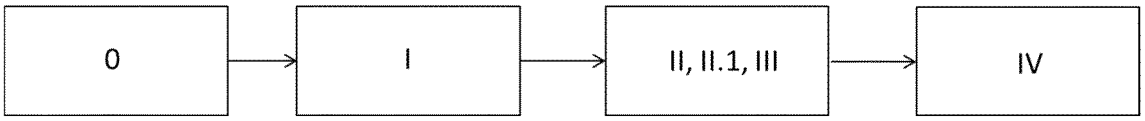
Figure 7:
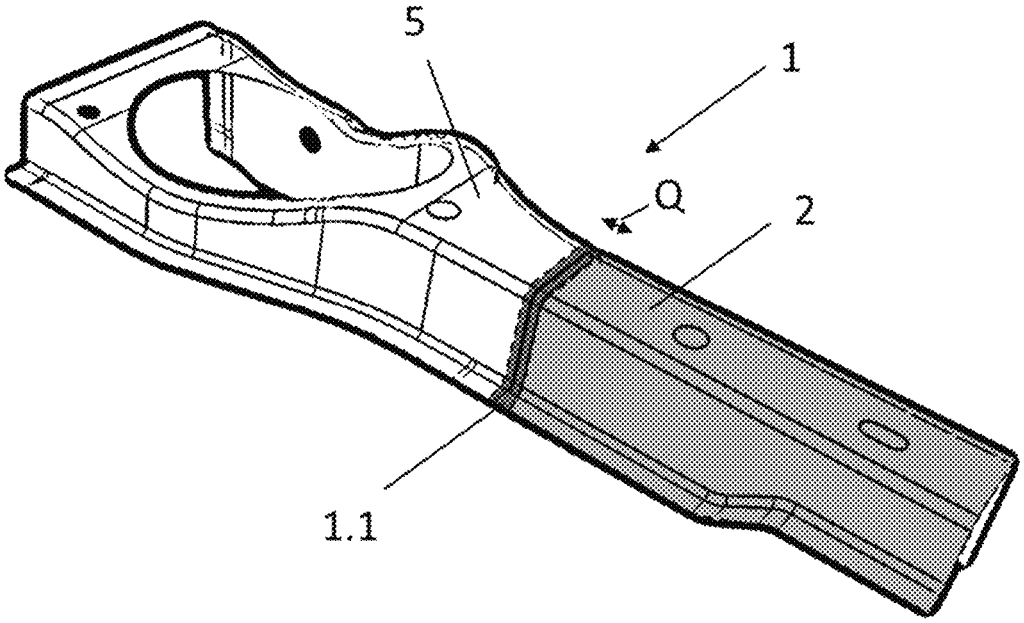
Figure 8:
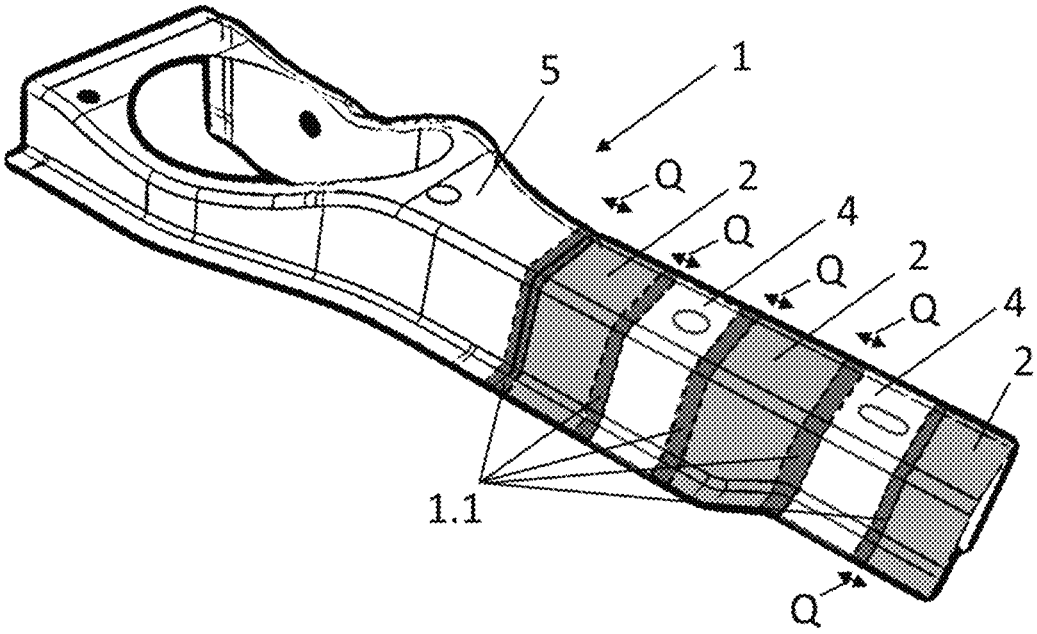
Figure 9:
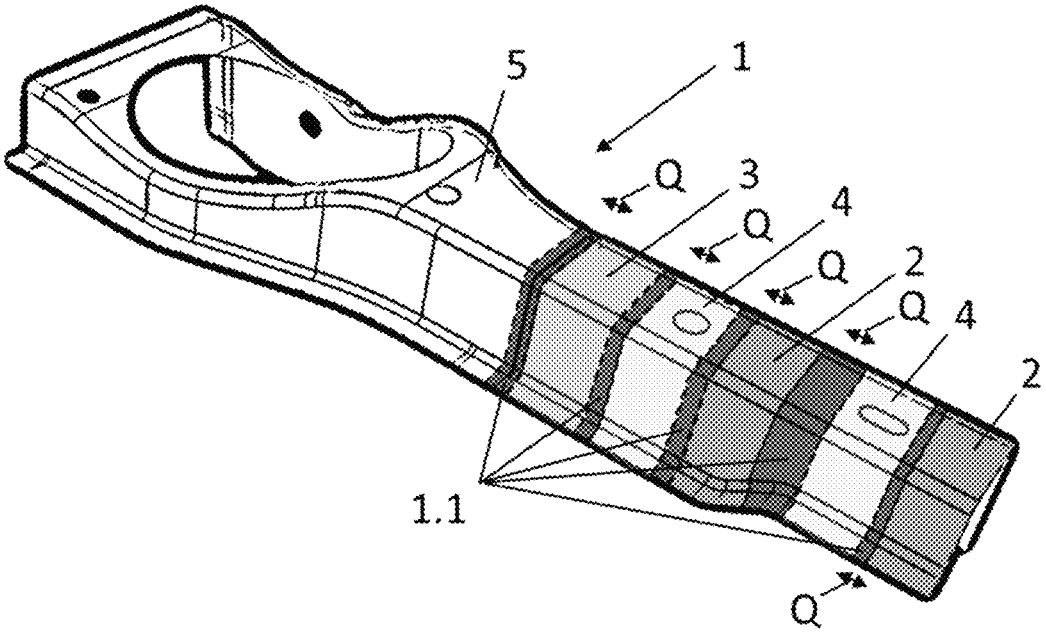

FIG. 1) shows a schematic flow chart of one embodiment of the process of the invention according to a first working example, FIG. 2) shows a schematic flow chart of one embodiment of the process of the invention according to a second working example, FIG. 3) shows a schematic flow chart of one embodiment of the process of the invention according to a third working example, FIG. 4) shows a schematic flow chart of one embodiment of the process of the invention according to a fourth working example, FIG. 5) shows a schematic flow chart of one embodiment of the process of the invention according to a fifth working example, FIG. 6) shows a schematic flow chart of one embodiment of the process of the invention according to a sixth working example, FIG. 7) shows a schematic perspective view of a quenched and tempered sheet steel component according to a first working example, FIG. 8) shows a schematic perspective view of a quenched and tempered sheet steel component according to a second working example, and FIG. 9) shows a schematic perspective view of a quenched and tempered sheet steel component according to a third working example.

FIGS. 1 to 6 represent schematic flow charts of various embodiments of the process of the invention.

(0) Identifies a device or apparatus for the shaping of a sheet steel, in which the sheet steel is shaped or formed, more particularly given a near-net shape, preferably by cold shaping or forming, in order to provide a preformed sheet steel for the ongoing operation. The device (I) comprises means for shaping the sheet steels. The device (0) may be configured in the form of one or more tools.

(I) Identifies a device or apparatus for at least partly austenitizing a provided sheet steel, in which the sheet steel is austenitized at a temperature of at least Ac1, more particularly at least Ac3 or above Ac3. The device (I) comprises means for at least partly heating the sheet steels provided. The sheet steel provided may in particular also be completely heated or austenitized.

The device (I) may be configured in the form of a furnace, as in the form of a continuous furnace, for example.

(II) Identifies a device or apparatus for at least partly hardening an at least partly austenitized sheet steel, in which the at least partly austenitized sheet steel is hardened to give an at least partly hardened sheet steel component, where the at least partly austenitized sheet steel is cooled to a temperature below Ms. The device (II) comprises means for actively cooling the at least partly austenitized sheet steels, said means comprising, for example, at least one tool and/or a medium for the hardening. The at least one tool may be configured as a press-hardening tool (II.1), as a hot-forming and press-hardening tool (II.2), as a hot-forming, press-hardening and annealing tool (II.2, III) or a press-hardening and annealing tool (II.1, III). The at least one tool may additionally have further functions, and may, for example, comprise means for trimming and/or making holes (IV).

(III) Identifies a device or apparatus for at least partly annealing an at least partly hardened sheet steel component, in which the at least partly hardened sheet steel component is quenched and tempered to give an at least partly quenched and tempered sheet steel component, where the at least partly hardened sheet steel component is annealed at a temperature of less than Ac1. The device (III) comprises means for actively temperature-conditioning the at least partly hardened sheet steel components, said means comprising, for example, at least one tool and/or one medium for annealing, where different temperature zones are provided in order to allow different regions (2, 3, 4, 5) having different properties to be established on the sheet steel component (1) for at least partial quenching and tempering. The at least one tool may be configured as an annealing tool (III.1) separately or integrated in a tool, more particularly for hot-forming and/or press hardening (II.1, II.2). The at least one tool may additionally have further functions, and may, for example, comprise means for trimming and/or making holes (IV).

(IV) Identifies a device or apparatus for afterworking an at least partly quenched and tempered sheet steel component, in which the at least partly quenched and tempered sheet steel component is afterworked, more particularly cut and/or given holes. The device (IV) comprises means for machining the at least partly quenched and tempered sheet steel components. Where the device (IV) comprises means for trimming and/or making holes, the means in question may be thermal means, in the form of a laser, for example, or mechanical means, such as one or more cutting and/or punching tools, for example. The device (IV) may be configured separately or integrated in a tool, more particularly for hot-forming and/or press hardening (11.1, 11.2) or annealing (III).

FIG. 1 shows four separate devices (I, II, III, IV) in which the process of the invention for producing a quenched and tempered sheet steel component (1) of the invention can be implemented. A flat sheet steel is provided and is austenitized completely at a temperature above Ac3 in a furnace (I). The austenitized sheet steel is subsequently removed from the furnace (I) and transferred using suitable transfer means into a hot-forming and press-hardening tool (II.2), in which the austenitized sheet steel is hot-formed and cooled to a temperature below Ms and therefore hardened to give a sheet steel component. The hardened sheet steel component is subsequently transferred using suitable transfer means into an annealing tool (III), in which the hardened sheet steel component is annealed at different temperatures to give a quenched and tempered sheet steel component (1) having regions (2, 3, 4, 5) with different properties. The quenched and tempered sheet steel component (1) may lastly be transferred using suitable transfer means into a tool (IV) for trimming and/or making holes, by means of laser, for example. After the trimming and/or hole-making in the tool (IV), the fully fabricated, quenched and tempered sheet steel component (1) can be removed.

In the second embodiment in FIG. 2, the devices (III, IV) are combined in one device or in one tool in comparison to the first embodiment in FIG. 1. The annealing tool (III) possesses the additional function of additionally machining or remachining, more particularly cutting and/or making holes in, the sheet steel component for quenching and tempering, this being accomplished, for example, via cutting and/or punching tools (IV) additionally integrated or disposed in or on the annealing tool (III).

In the third embodiment in FIG. 3, the devices (II, III, IV) are combined in one device, such as a transfer press, for example, or in one tool. The hot-forming and press-hardening tool (II.2) is an annealing tool (III) at the same time and additionally possesses cutting and/or punching tools (IV). The embodiment may also be such that the devices (II, III, IV) are installed separately, or at least partly separately, from one another in one device.

In the fourth embodiment in FIG. 4 the devices (II, III) are combined in one device or in one tool. The tool comprises a hot-forming, press-hardening and annealing tool (II.2, III). The remachining device (IV) is configured separately.

In accordance with the first embodiment of figurel, the fifth embodiment in FIG. 5 also shows four separate devices (0, I, II, III); in contradiction to the first four embodiments, in which a substantially flat sheet steel is provided in the form of a blank and subsequently austenitized, here and in the sixth embodiment as well, a preformed steel sheet is provided for the austenitizing. Since the preformed steel sheet preferably already has a near-net-shaped geometry, there is also no need for hot-forming, and so the hardening is carried out in a press-hardening tool (II.1) in the device (II). Remachining in a further device, not shown, is conceivable as and when required.

In the sixth embodiment in FIG. 6 the devices (II, III) are combined in one device or in one tool. The tool comprises a press-hardening and annealing tool (II.1, III). The remachining device (IV) is configured separately.

In an investigation, a strand was cast in a continuous casting unit from three melts A, B and C having the chemical composition indicated in table 1, and each strand was divided into slabs. The slabs were subsequently heated through in a walking beam furnace at temperatures above 1100° C. and hot-rolled on a hot strip line to give a hot strip of 3.2 mm. The hot strips were conditioned and subsequently cold-rolled to give cold strips of 1.5 mm. The cold strips produced from melts A and C were coated conventionally with an aluminum and silicon coating, whereas the cold strip produced from melt B remained uncoated. The cold strips produced from melts A and C and the cold strip from melt B were each separated to form seven steel sheets, which were subjected to cold forming in a device (0), the sheets being provided in each case in the form of a preformed steel sheet.

As outlined in the fifth embodiment in accordance with FIG. 5, the total of 21 steel sheets provided were fully austenitized above Ac3 in a furnace (I) at a furnace temperature of 920° C. for a duration of 300 s; see table 2. The austenitized steel sheets were transferred into a press-hardening tool (II.1) in a transfer time of 7 s, and in this tool the austenitized steel sheets were cooled or quenched and thus hardened to give sheet steel components. The temperature of the press-hardening tool (II.1) was a uniform 224° C. for the AS-coated steel sheets and a uniform 240° C. for the uncoated steel sheets, with the closed duration of the press-hardening tool (11.1) being 6 s in each case. The withdrawal temperatures measured for each of the hardened sheet steel components are apparent from table 2. Temporally immediately after the hardening, the hardened sheet steel components were transferred into an annealing tool (III), where cooling below Mf was prevented. The annealing tool (III) possessed four differently temperature-conditionable zones, allowing the establishment of regions (2, 3, 4, 5) having up to four different properties on the sheet steel component (1) for quenching and tempering, as well. The temperatures established in the respective zones of the annealing tool (III), and also the annealing temperatures TP1 to TP4 measured in the corresponding regions (2, 3, 4, 5) having different properties, on the quenched and tempered sheet steel components (1) on withdrawal from the annealing tool (III), and also the corresponding closed times of the annealing tool (III) for the purpose of establishing the different properties, are apparent from table 2. The quenched and tempered sheet steel components (1) of embodiments 1, 6 and 7 are shown illustratively in FIGS. 7, 8 and 9, schematically in a perspective view.

Though not depicted here, it is possible to produce sheet steel components which have only partial austenitization, only partial hardening and only partial quenching and tempering.

FIG. 7 shows a quenched and tempered sheet steel component (1) having a first region (2) having a first property and a fourth region (5) having a fourth property, where a transition region (1.1) separates the two regions (2, 5) from one another with a defined distance in the transverse extent (Q), the transverse extent (Q) being at least 10 mm.

FIG. 8 shows a quenched and tempered sheet steel component (1) having three first regions (2) having a first property, two third regions (4) having a third property, and one fourth region (5) having a fourth property, where transition regions (1.1) separate the different regions (2, 4, 5) from one another, in each case with a defined distance in the transverse extent (Q). The three first regions (2) are present in sections on the quenched and tempered sheet steel component (1), with two third regions (4) being present between the three first regions (1). The fourth region (5) defines an end section on the quenched and tempered sheet steel component (1).

FIG. 9 shows by comparison with FIG. 8 a quenched and tempered sheet steel component (1) having two first regions (2) having a first property, one second region (3) having a second property, two third regions (4) having a third property, and one fourth region (5) having a fourth property, where transition regions (1.1) separate the different regions (2, 3, 4, 5) from one another, in each case with a defined distance in the transverse extent (Q). The transition region (1.1) between the first third region (4) and the second first region (2) has wider dimensioning in its transverse extent (Q) by comparison with the other transition regions (1.1).

Table 3 provides a detailed overview of the different properties established in the respective regions (2, 3, 4, 5) on the quenched and tempered sheet steel components (1) by the process of the invention, as indicated in table 2.

The annealing temperatures (TP1, TP2, TP3, TP4) refer to the temperature in the corresponding regions (2, 3, 4, 5) on the quenched and tempered sheet steel component (1) on or shortly after withdrawal from the annealing tool (III). They may not and do not have to correspond to the tool temperatures in the zones which are in contact with the regions (2, 3, 4, 5).

Measurement Methods

- Hv_rC: Vickers hardness (Hv1)
- A_RA, G_RA: both parameters were ascertained from the x-ray diffractogram, in accordance with DIN 13925 "X-ray diffractometry of polycrystalline and amorphous materials" using the Rietveld method.
- S_RA: calculated from G_RA according to specified formula Abbreviations:

Table 1:

- Surf: coating surface, U: uncoated, AS: aluminum-silicon-coated
- A_F40: fraction (number %) of ferrite grains having an equivalent diameter>40 μm Table 2:

- T_ToolA: tool temperature, press-hardening tool
- T_Abs: temperature of component on withdrawal from press-hardening tool
- Z_Abs: press-hardening tool closed time
- T_ToolX: temperature of annealing tool in tool region X (X:1-4)

TPX: component temperature in the region in contact with tool region X of the annealing tool on withdrawal from annealing tool Z_Temp: annealing tool closed time Table 3:

Hv_rC: Vickers hardness (Hv1)

A_RA: fraction of residual austenite in the structure (vol. %)

G_RA: lattice constant of residual austenite

S_RA: calculated from G_RA by the formula indicated in the text; describes the residual austenite stability The process of the invention enables the production of cost-favorable sheet steel components having goal-directed properties, more particular vehicle body parts such as, for example, A pillars, B pillars or both side and crossmembers, and also combinations thereof, such as a door ring, for example. The process of the invention is applicable not only to monolithic sheet steels of constant thickness, but also to monolithic sheet steels of varying thickness (tailored rolled blanks). The process of the invention, furthermore, can also be applied generally to tailored products, examples being at least two steel sheets joined to one another, in the form of patchwork blanks or tailored welded blanks, with differing thickness and/or grade.

TABLE 1

| Melt | C wt. % | Si wt. % | Mn wt. % | Al wt. % | N wt. % | P wt. % | S wt. % | Cr wt. % | Ti wt. % | B wt. % | Nb wt. % | Mo wt. % | V wt. % | Ni wt. % | Cu wt. % | Further wt. % | Surf | A_F40 % (by number) |
|---|---|---|---|---|---|---|---|---|---|---|---|---|---|---|---|---|---|---|
| A | 0.21 | 1.2 | 2.3 | 0.3 | 0.004 | 0.016 | 0.0015 | 0.23 | — | — | 0.025 | — | — | — | — | — | AS | 0 |
| B | 0.19 | 1.5 | 1.6 | 0.02 | 0.003 | 0.014 | 0.0013 | 0 | 0.025 | 0.0021 | 0 | 0.25 | — | — | — | — | U | 1 |
| C | 0.23 | 1.5 | 2.4 | 0.03 | 0.001 | 0.007 | 0.0011 | 0.2 | 0.1 | 0.15 | 0.07 | 0.2 | 0.1 | 0.15 | 0.07 | Sn: 0.002 Ca: 0.002 Mg: 0.001 | AS | 1 |

TABLE 2

| Component | Melt | T_furn ° C. | Z_furn s | Z_trans s | T_toolA ° C. | T_Abs ° C. | Z_Abs s | T_tool1 ° C. |
|---|---|---|---|---|---|---|---|---|
| 1 | A | 920 | 300 | 7 | 224 | 266 | 6 | 410 |
| 2 | A | 920 | 300 | 7 | 224 | 264 | 6 | 420 |
| 3 | A | 920 | 300 | 7 | 224 | 265 | 6 | 420 |
| 4 | A | 920 | 300 | 7 | 224 | 262 | 6 | 460 |
| 5 | A | 920 | 300 | 7 | 224 | 262 | 6 | 420 |
| 6 | A | 920 | 300 | 7 | 224 | 267 | 6 | 360 |
| 7 | A | 920 | 300 | 7 | 224 | 259 | 6 | 390 |
| 8 | B | 920 | 300 | 7 | 240 | 283 | 6 | 410 |
| 9 | B | 920 | 300 | 7 | 240 | 284 | 6 | 420 |
| 10 | B | 920 | 300 | 7 | 240 | 282 | 6 | 420 |
| 11 | B | 920 | 300 | 7 | 240 | 275 | 6 | 460 |
| 12 | B | 920 | 300 | 7 | 240 | 279 | 6 | 420 |
| 13 | B | 920 | 300 | 7 | 240 | 284 | 6 | 360 |
| 14 | B | 920 | 300 | 7 | 240 | 283 | 6 | 390 |
| 15 | B | 920 | 300 | 7 | 218 | 262 | 6 | 410 |
| 16 | B | 920 | 300 | 7 | 218 | 263 | 6 | 420 |
| 17 | B | 920 | 300 | 7 | 218 | 261 | 6 | 420 |
| 18 | B | 920 | 300 | 7 | 218 | 251 | 6 | 460 |
| 19 | B | 920 | 300 | 7 | 218 | 257 | 6 | 420 |
| 20 | B | 920 | 300 | 7 | 218 | 264 | 6 | 360 |
| 21 | B | 920 | 300 | 7 | 218 | 262 | 6 | 390 |

| Component | TP1 ° C. | T_tool2 ° C. | TP2 ° C. | T_tool3 ° C. | TP3 ° C. | T_tool4 ° C. | TP4 ° C. | Z_Temp s |
|---|---|---|---|---|---|---|---|---|
| 1 | 399 | 305 | 299 | | | | | 40 |
| 2 | 414 | | | | | 20 | 50 | 30 |
| 3 | 413 | | | 520 | 501 | | | 30 |
| 4 | 446 | 405 | 399 | | | 40 | 68 | 10 |
| 5 | 414 | 385 | 381 | 550 | 533 | | | 20 |
| 6 | 349 | | | 570 | 549 | 30 | 59 | 100 |
| 7 | 380 | 345 | 341 | 530 | 510 | 70 | 102 | 50 |
| 8 | 402 | 305 | 300 | | | | | 40 |
| 9 | 406 | | | | | 20 | 49 | 30 |
| 10 | 411 | | | 520 | 498 | | | 30 |
| 11 | 450 | 405 | 402 | | | 40 | 68 | 10 |
| 12 | 408 | 385 | 382 | 550 | 533 | | | 20 |
| 13 | 351 | | | 570 | 551 | 30 | 59 | 100 |
| 14 | 381 | 345 | 339 | 530 | 508 | 70 | 99 | 50 |
| 15 | 398 | 305 | 303 | | | | | 40 |
| 16 | 418 | | | | | 20 | 50 | 30 |
| 17 | 416 | | | 520 | 496 | | | 30 |

TABLE 2-continued

| | | | | | | | | |
|---|---|---|---|---|---|---|---|---|
| 18 | 442 | 405 | 393 | | | 40 | 71 | 10 |
| 19 | 417 | 385 | 381 | 550 | 533 | | | 20 |
| 20 | 348 | | | 570 | 553 | 30 | 61 | 100 |
| 21 | 380 | 345 | 340 | 530 | 505 | 70 | 100 | 50 |

| | First region | | | |
|---|---|---|---|---|
| Component | Hv_rC | A_RA % | G_RA nm | S_RA nm |
| 1 | 395 | 12 | 0.3610 | 0.3615 |
| 2 | 399 | 12 | 0.3610 | 0.3615 |
| 3 | 399 | 11 | 0.3612 | 0.3617 |
| 4 | 403 | 12 | 0.3606 | 0.3611 |
| 5 | 405 | 11 | 0.3609 | 0.3614 |
| 6 | 366 | 11 | 0.3607 | 0.3612 |
| 7 | 393 | 11 | 0.3608 | 0.3613 |
| 8 | 387 | 11 | 0.3612 | 0.3615 |
| 9 | 391 | 10 | 0.3612 | 0.3615 |
| 10 | 391 | 10 | 0.3612 | 0.3615 |
| 11 | 393 | 10 | 0.3608 | 0.3611 |
| 12 | 398 | 11 | 0.3610 | 0.3613 |
| 13 | 356 | 10 | 0.3608 | 0.3611 |
| 14 | 384 | 11 | 0.3610 | 0.3613 |
| 15 | 413 | 12 | 0.3617 | 0.3623 |
| 16 | 413 | 13 | 0.3614 | 0.3620 |
| 17 | 408 | 14 | 0.3614 | 0.3620 |
| 18 | 432 | 12 | 0.3607 | 0.3613 |
| 19 | 399 | 14 | 0.3611 | 0.3617 |
| 20 | 357 | 13 | 0.3612 | 0.3618 |
| 21 | 418 | 12 | 0.3612 | 0.3618 |

| | Second region | | | |
|---|---|---|---|---|
| Component | Hv_rC | A_RA % | G_RA nm | S_RA nm |
| 1 | 427 | 10 | 0.3593 | 0.3598 |
| 2 | | | | |
| 3 | | | | |
| 4 | 421 | 10 | 0.3598 | 0.3603 |
| 5 | 416 | 11 | 0.3604 | 0.3609 |
| 6 | | | | |
| 7 | 407 | 10 | 0.3601 | 0.3606 |
| 8 | 415 | 9 | 0.3595 | 0.3598 |
| 9 | | | | |
| 10 | | | | |
| 11 | 405 | 10 | 0.3599 | 0.3602 |
| 12 | 408 | 10 | 0.3605 | 0.3608 |
| 13 | | | | |
| 14 | 395 | 10 | 0.3603 | 0.3605 |
| 15 | 438 | 12.35 | 0.3596 | 0.3602 |
| 16 | | | | |
| 17 | | | | |
| 18 | 430 | 12.35 | 0.3600 | 0.3606 |
| 19 | 422 | 12.35 | 0.3605 | 0.3611 |
| 20 | | | | |
| 21 | 416 | 12.35 | 0.3602 | 0.3608 |

| | Third region | | | |
|---|---|---|---|---|
| Component | Hv_rC | A_RA % | G_RA nm | S_RA nm |
| 1 | | | | |
| 2 | | | | |
| 3 | 369 | 3 | 0.3618 | 0.3623 |
| 4 | | | | |
| 5 | 368 | 3 | 0.3619 | 0.3624 |
| 6 | 300 | — | — | — |
| 7 | 351 | 5 | 0.3625 | 0.3630 |
| 8 | | | | |
| 9 | | | | |
| 10 | 367 | 2 | 0.3624 | 0.3627 |
| 11 | | | | |
| 12 | 365 | 3 | 0.3623 | 0.3626 |

-continued

| | | | | |
|---|---|---|---|---|
| 13 | 301 | — | — | — |
| 14 | 349 | 6 | 0.3626 | 0.3629 |
| 15 | | | | |
| 16 | | | | |
| 17 | 377 | 3 | 0.36147419 | 0.3621 |
| 18 | | | | |
| 19 | 372 | 4 | 0.36141763 | 0.3620 |
| 20 | 304 | — | — | — |
| 21 | 358 | 6 | 0.36197217 | 0.3626 |

| | Fourth region | | | |
|---|---|---|---|---|
| Component | Hv_rC | A_RA % | G_RA nm | S_RA nm |
| 1 | | | | |
| 2 | 490 | — | — | — |
| 3 | | | | |
| 4 | 493 | — | — | — |
| 5 | | | | |
| 6 | 488 | — | — | — |
| 7 | 489 | 3 | 0.3587 | 0.3592 |
| 8 | | | | |
| 9 | 473 | — | — | — |
| 10 | | | | |
| 11 | 469 | — | — | — |
| 12 | | | | |
| 13 | 473 | — | — | — |
| 14 | 472 | 2 | 0.3586 | 0.3589 |
| 15 | | | | |
| 16 | 495 | — | — | — |
| 17 | | | | |
| 18 | 503 | — | — | — |
| 19 | | | | |
| 20 | 495 | — | — | — |
| 21 | 495 | 3 | 0.3587 | 0.3593 |

The invention claimed is:

1. An at least partly quenched and tempered sheet steel component, wherein the at least partly quenched and tempered sheet steel component has regions having different properties: a first region having a first property, comprising a microstructure having a wt % with residual austenite between 3% and <35%, 35% to 97% martensite, up to 30% bainite and unavoidable structure constituents, and a second region having a second property, comprising a structure having a residual austenite fraction which is lower by comparison with the first region, balance martensite and optionally bainite and unavoidable structure constituents;

a third region having a third property, comprising a structure having a residual austenite fraction which is lower by comparison with the first region and, if present, by comparison with the second region, balance martensite and optionally bainite and unavoidable structure constituents; and a fourth region having a fourth property, comprising a structure having <3% residual austenite, balance martensite and optionally bainite and unavoidable structure constituents;

wherein the at least partly quenched and tempered sheet steel component comprises the following chemical composition in wt %:

C=0.08 to 0.5;

Si+Al>0.75, and Si+2*Al<5, wherein the Si is at least 0.1; and

Mn=0.5 to 4, balance Fe and unavoidable impurities.

2. The sheet steel component as claimed in claim 1, where the sheet steel component has the first, second, third and fourth regions, the first region having a residual austenite stability value S_RA>=0.3590 nm and/or a structure hardness value Hv_rC and wherein at least one of the second, third and fourth region having the following residual austenite stability values S_RA and/or structure hardness values Hv_rC:

the second region with an S_RA which is less than the S_RA of the first region, and with an Hv_rC which is greater by at least 10 Hv than the Hv_rC of the first region, and the third region with an S_RA which is greater than the S_RA of the first region and of the second region, and with an Hv_rC which is less by at least 10 Hv than the Hv_rC of the first region, and the fourth region, if residual austenite>0 and <3% is present, with S_RA<0.3950 nm and/or with an Hv_rC which is greater by at least 40 Hv than the Hv_rC of the first region and greater by at least 10 Hv than the Hv_rC of the second region, where the residual austenite stability value S_RA is determined with the following formula:

$$S_RA = G_RA - 0.0002\ \text{nm}*\%\ Si - 0.0006\ \text{nm}*\%\ Al + 0.0004\ \text{nm}*\%\ Mn$$, where $G_RA$ defines the lattice constant of the residual austenite, where the structure hardness value Hv_rC of the first region meets the following condition: Hv_rC<320+800*(% C+% N)+75*(% Nb)^0.5.

3. The sheet steel component as claimed in claim 2, where the sheet steel component, between the regions having different properties, has one or more transition regions, where the transition region or regions space the various regions from one another with a transverse extent (Q) of at least 5 mm.

4. The sheet steel component of claim 1, further comprising one or more alloy elements from the group P, S, N, Cr, Mo, Ti, B, Nb, V, Ni, Cu, Sn, Ca, Mg, REM:

P up to 0.1,
S up to 0.1,
N up to 0.1,
Cr up to 1.5,
Mo up to 1,
Ti up to 0.2,
B up to 0.01,
Nb up to 0.2,
V up to 0.5,
Ni up to 2,
Cu up to 2,
Sn up to 0.5,
Ca up to 0.1,
Mg up to 0.1,
REM up to 0.1.

5. An at least partly quenched and tempered sheet steel component, wherein the at least partly quenched and tempered sheet steel component has regions having different properties: a first region having a first property, comprising a microstructure having a wt % with residual austenite between 3% and <35%, 35% to 97% martensite, up to 30% bainite and unavoidable structure constituents, and at least one further region having a further property, comprising at least one of the following properties:

a second region having a second property, comprising a structure having a residual austenite fraction which is lower by comparison with the first region, balance martensite and optionally bainite and unavoidable structure constituents;

a third region having a third property, comprising a structure having a residual austenite fraction which is lower by comparison with the first region and, if present, by comparison with the second region, balance martensite and optionally bainite and unavoidable structure constituents; and a fourth region having a fourth property, comprising a structure having <3% residual austenite, balance martensite and optionally bainite and unavoidable structure constituents;

wherein the at least partly quenched and tempered sheet steel component comprises the following chemical composition in wt %:

C=0.08 to 0.5;

Si+Al>0.75, and/or Si+2*Al<5, wherein the Si is at least 0.1;

Mn=0.5 to 4; and

Cr up to 1.5;

balance Fe and unavoidable impurities.

6. The sheet steel component as claimed in claim 5, wherein Al<=0.3.

7. The sheet steel component as claimed in claim 5, wherein Si>=1.2.

8. The sheet steel component of claim 5, further comprising one or more alloy elements from the group P, S, N, Mo, Ti, B, Nb, V, Ni, Cu, Sn, Ca, Mg, REM:

P up to 0.1,
S up to 0.1,
N up to 0.1,
Mo up to 1,
Ti up to 0.2,
B up to 0.01,
Nb up to 0.2,
V up to 0.5,
Ni up to 2,
Cu up to 2,
Sn up to 0.5,
Ca up to 0.1,
Mg up to 0.1,
REM up to 0.1.

9. The sheet steel component as claimed in claim 1, wherein the at least partly quenched and tempered sheet steel component comprises Si+Al>1.3 chemical composition in wt %.

10. The sheet steel component as claimed in claim 5, wherein the at least partly quenched and tempered sheet steel component comprises Si+Al>1.3 chemical composition in wt %.

* * * * *